United States Patent [19]

Probst

[11] 4,053,183

[45] Oct. 11, 1977

[54] APPARATUS FOR DISLODGING AND COLLECTING MATERIALS

[75] Inventor: John F. Probst, Hartland, Wis.

[73] Assignee: P.A.L. Development Corporation, Butler, Wis.

[21] Appl. No.: 705,761

[22] Filed: July 16, 1976

[51] Int. Cl.[2] ..... E04D 15/00

[52] U.S. Cl. ..... 299/36; 15/93 R; 30/170; 37/28; 198/518

[58] Field of Search ..... 15/93 R; 198/518, 520; 299/36, 37; 37/28; 30/170

[56] References Cited

U.S. PATENT DOCUMENTS

| | | | |
|---|---|---|---|
| 682,731 | 9/1901 | Munson | 37/28 |
| 2,363,251 | 11/1944 | Jurisich | 198/518 X |
| 3,779,605 | 12/1973 | Nieman | 299/37 |

FOREIGN PATENT DOCUMENTS

| | | | |
|---|---|---|---|
| 2,300,668 | 7/1974 | Germany | 30/170 |

*Primary Examiner*—Ernest R. Purser

*Attorney, Agent, or Firm*—Andrus, Sceales, Starke & Sawall

[57] ABSTRACT

A self-propelled apparatus for dislodging and collecting materials from a surface and having particular use in removing roofing from a roof deck. The apparatus includes a small tractor-like vehicle having a frame and a blade extends forwardly of the frame and is adapted to move along the surface. A brush is mounted adjacent the forward edge of the blade and is adapted to sweep the dislodged material up the blade to an endless conveyor which is mounted on the frame. The brush includes a series of rigid fingers which are located within the bristles and act to move heavy materials up the inclined blade to the conveyor.

12 Claims, 4 Drawing Figures

APPARATUS FOR DISLODGING AND COLLECTING MATERIALS

BACKGROUND OF THE INVENTION

One common type of built-up roofing for commercial and industrial buildings consists of a layer of insulation board covered by a number of layers of roofing paper. The insulation board, in the form of 2 feet × 4 feet sections, is nailed to the roof deck and the roofing paper is then tar mopped to the insulation board.

In another type of built-up roofing, the insulation board is eliminated and the first ply of roofing paper is nailed to the roof deck and additional plies or layers of paper are tar mopped over the first layer.

During a period of years additional layers of roofing paper may be applied over the original roof. Eventually the thickness of the roof may increased to the point where additional layers cannot be applied to the roof due to the added weight, and the entire roofing must then be removed. In some cases, depending on the conditions, the insulation board must be removed as well, and new layers of insulation board and roofing paper applied.

U.S. Pat. No. 3,542,433 discloses a self-propelled apparatus which can be utilized for removing roofing prior to application of a new roof. By use of the apparatus of the aforementioned patent, the roofing is dislodged from the roof and moved up an inclined platform. Workmen then hand carry the dislodged sections of the roofing to a suitable disposal site.

The use of the roof removing apparatus of the aforementioned patent substantially reduces the period of time required in removing the roofing, as compared to hand scraping methods used in the past. However, a certain amount of hand labor is nevertheless required in order to transfer the dislodged pieces of roofing to carts, or hand carry the dislodged material to a disposal site.

SUMMARY OF THE INVENTION

The present apparatus relates to a self-propelled apparatus for dislodging materials, such as roofing, from a surface and conveying the dislodged materials to a collection site. In accordance with the invention, the apparatus includes a small tractor-like vehicle having a frame and a blade or scraper member extends forwardly of the vehicle and is adapted to engage the surface or roof deck and scrape the roofing from the deck. A brush is mounted adjacent the forward edge of the blade and is rotated to sweep the dislodged material up the inclined blade to an endless conveyor which is mounted on the frame of the vehicle. The conveyor moves the dislodged material to the rear end of the vehicle where it is deposited in a cart and hauled from the site.

The brush includes a shaft having a plurality of bristles which extend outwardly from the shaft. In addition, a series of rigid fingers extend radially from the shaft and are located within the mass of bristles.

As the brush is rotated, the bristles will flex and the rigid fingers will mate with grooves formed in the blade. The bristles serve to sweep lightweight materials up the inclined blade, while the rigid fingers will function to sweep heavier materials, such as large sections of roofing, up the blade to the endless conveyor.

The apparatus of the invention has particular use in removing old roofing in preparation for installing a new roof. Depending on the nature of the roof, the blade can be used to dislodge the roofing and convey the dislodged roofing to a cart or container for removal from the site. In other instances, the apparatus may be used to gather up roofing that has been dislodged by a separate apparatus, such as that shown in U.S. Pat. No. 3,542,433.

As the device of the invention acts to dislodge or to remove roofing from a roof deck, as well as depositing the dislodged roofing in carts for hauling to a disposal site, a substantial portion of hand labor is eliminated and thus the overall time and cost of the roof removal operation is reduced.

While the apparatus has particular application for removing roofing it can also be used to dislodge and collect other materials such as gravel, soil, waste materials, and the like, particularly where the materials may have considerable weight or bulk.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figures 1, 3:
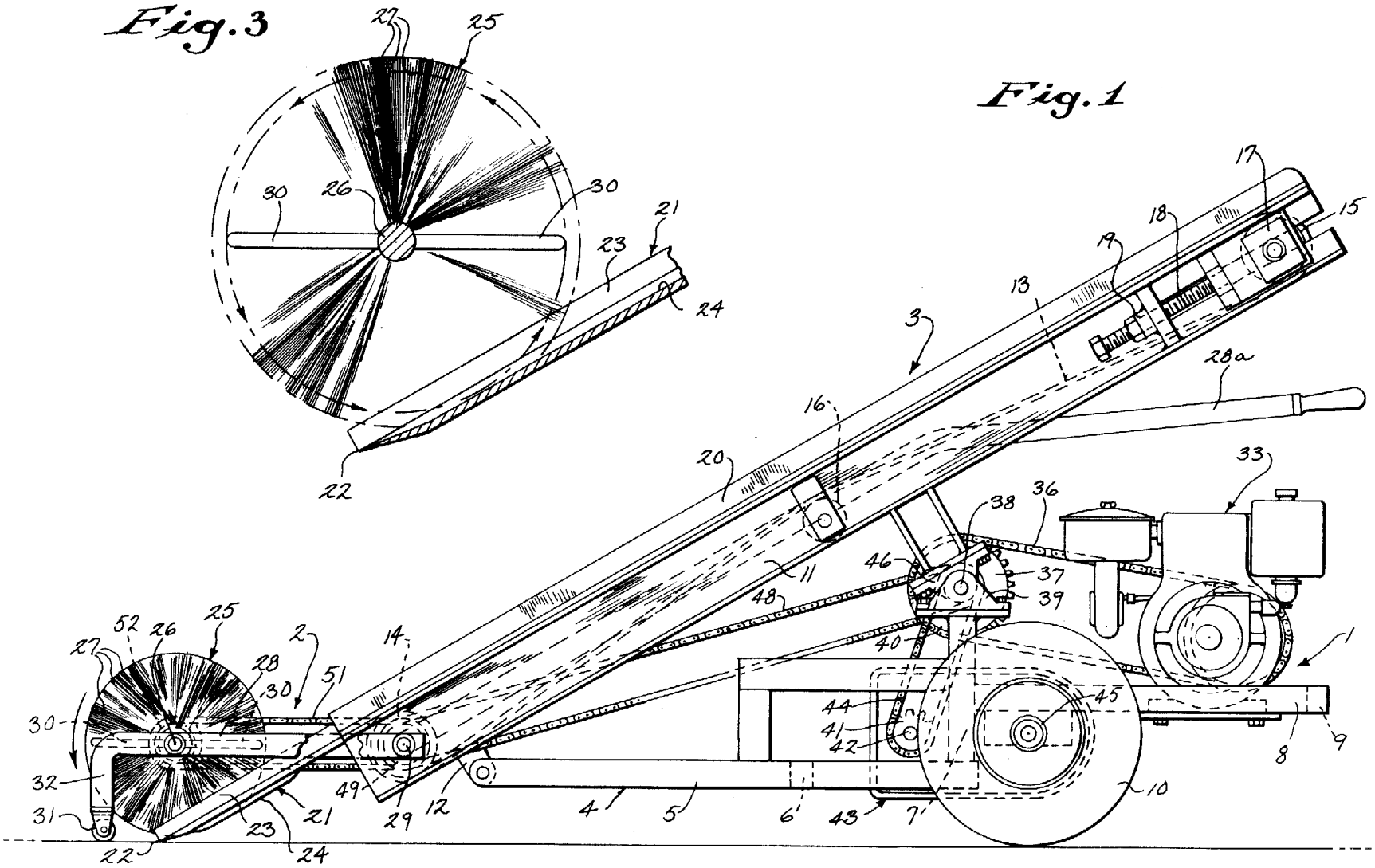
FIG. 1 is a side elevation of the apparatus of the invention.
FIG. 3 is an enlarged vertical section taken along line 3—3 of FIG. 2 and showing the brush construction.

The drawings illustrate a self-propelled apparatus to be used for scraping or dislodging material from a surface and conveying the dislodged material to a collection site. The apparatus includes a small tractor-like vehicle 1 having a scraping attachment 2 attached to its forward end, and a conveyor mechanism 3 is mounted on the vehicle to convey the dislodged material from the scraping attachment to a collection site located at the rear of the vehicle.

The vehicle or tractor 1 includes a frame 4 composed of a pair of longitudinal frame members 5 that are connected together by a cross member 6. A pair of columns 7 extend upwardly from the frame members 5 and frame members 8 extend rearwardly from the central portions of the vertical columns 7. The rear ends of frame members 8 are connected together by a cross member 9.

To enable the vehicle to move over the surface or ground, a pair of wheels 10 are journalled on the frame.

The conveyor mechanism 3 is composed of a pair of longitudinal frame members 11 or side rails, and the frame members 5 are connected to lugs 12 on the side rails 11. With this construction, the frame 4 and the conveyor frame are an integral structure. However, the conveyor unit 3 can be removed from the frame 4 for transporting and in situations where the apparatus is to be hoisted onto a roof.

The conveyor unit 3 includes an endless belt 13 that extends upwardly and rearwardly and is trained over a drive roll 14 located at the forward end of the frame and an idler roll 15 mounted at the rear end of the frame. In addition, the lower pass of the belt travels over an intermediate roll 16, as illustrated in FIG. 1.

To adjust the tension on the conveyor belt 13, the shaft of the idler roll 15 is journalled within bearing blocks 17 that are mounted for sliding movement with respect to the frame member 11. A threaded rod 18 is connected to each bearing block 17, and the rods are threaded with sleeves 19 carried by the frame members. By adjustment of the rods 18, the tension on the belt 13 can be varied, as desired.

To retain the dislodged material on the conveyor, a generally L-shaped side plate 20 is secured to the upper surface of each frame member 11 and extends laterally inward to a position over the respective side edge of the belt 13.

Figure 2:
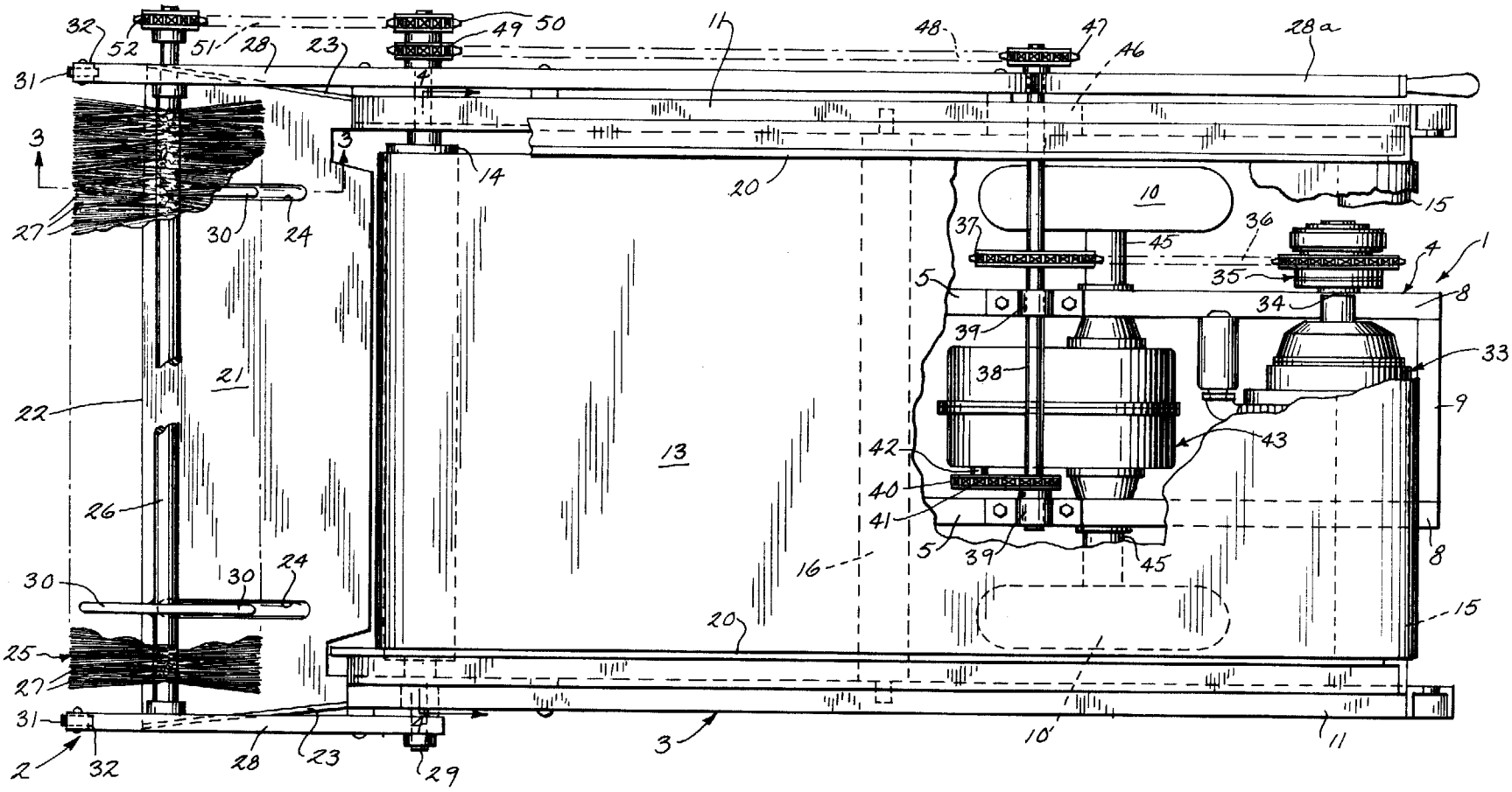
FIG. 2 is a top plan view of the apparatus with parts broken away.
Figure 4:
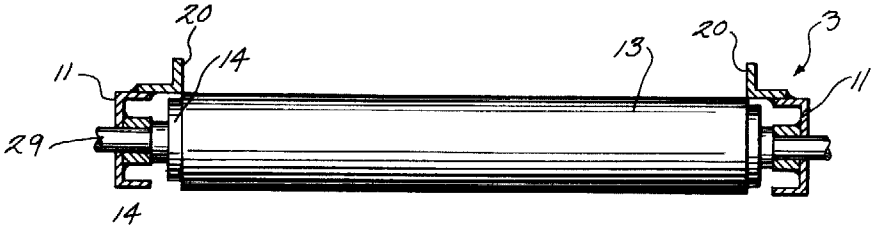
FIG. 4 is a section taken along line 4—4 of FIG. 2.

The scraping or dislodging attachment 2 includes a blade or scraping member 21 which is formed integrally with the conveyor 3 and extends forwardly from the conveyor, terminating in a generally sharpened edge 22. As shown in FIG. 2, the sides of the blade 21 flare outwardly and side flanges 23 extend upwardly from the sides of the blade.

Formed in the upper surface of the blade 21 is a pair of generally parallel grooves 24 which extend in a front-to-rear direction.

The scraping attachment 2 also includes a brush 25 which is mounted for rotation adjacent forward sharpened edge 22 of the blade 2. As best shown in FIG. 2, the brush 25 includes a central shaft 26 and a multiplicity of bristles 27 extend outwardly from the shaft. The bristles can be formed of either natural or synthetic material, such as plastic, and are relatively flexible, yet stiff.

The ends of the shaft 26 are journalled within arms 28 and arms 28 are mounted for pivoting movement on the shaft 29 of the drive roll 14. One of the arms 28*a* extends rearwardly to a position adjacent the rear of the tractor so that the operator, by raising and lower the arm 28, can correspondingly raise or lower the brush 25 with respect to the blade 21.

As the tractor moves over the surface, the blade edge 22 will dislodge material on the surface and the rotating brush will act to sweep the dislodged material up the incline blade 21 to the endless belt conveyor 13. To aid in moving heavy materials up the incline blade 21, the brush 25 is provided with a series of generally rigid fingers 30 which extend radially outwardly from the shaft 26. As shown in FIG. 2, the fingers 30 are located within the mass of bristles 27 and have a shorter length than the bristles so that the bristles project outwardly beyond the fingers 30. The fingers 30 mate or register with the grooves 24, and as the brush 25 is rotated the fingers 30 will rotate through the grooves and aid in moving or sweeping heavier materials up the blade to the conveyor belt 14.

To position the brush 25 relative to the blade 21, a pair of caster wheels 31 are mounted on the lower ends 32 of arm 28 and are adapted to ride on the surface or roof deck forwardly of the blade. The brush 25 and arms 28 are urged downwardly by gravity and the wheels 31 are positioned so that when the brush is in its normal position, the ends of the fingers 30 will be spaced slightly out of contact with the bottom of the grooves 24, thus insuring that the fingers will not rotate in contact with the blade.

While the bristles are relatively stiff they are flexible and if a heavy piece of material, such as a large section of dislodged roofing, moves onto the blade the bristles may flex and not provide sufficient force to move the roofing section up the blade. However, the fingers 30, being rigid, will engage the heavy roofing section and the weight of the brush 25 and arms 28, acting through the fingers 30, will move the heavy section up the blade, even though the bristles are incapable of providing this function.

To drive the vehicle, an engine 33 is mounted on the frame members 8 and the drive shaft 34 of the engine is connected to the input of a conventional clutch mechanism 35. The output of the clutch mechanism is connected through a chain 36 to a sprocket 37 on shaft 38 that extends transversely of the frame. Shaft 38 is journalled within bearing blocks 39 that are mounted on the upper ends of columns 7, and the shaft carries a sprocket 40 which is connected to a sprocket 41 on shaft 42 of transmission 43 by a chain 44. The transmission 43 is a conventional type which independently drives the axles 45 that carry the wheels 10.

The controls for the engine 33 and the clutch 35 are located to one side of the tractor, rather than to the rear, because the dislodged material is discharged from the rear end of the conveyor 3 into carts or other collection devices that are positioned at the rear of the tractor.

To drive the conveyor 3 the shaft 38 is extended and is journalled within a bearing assembly 46 on one of the frame members 11, and the outer end of the shaft 38 carries a sprocket 47 which is connected through chain 48 to a sprocket 49 on drive roll shaft 29. The drive for the brush 25 is taken from the drive roll shaft 29 and in this regard a sprocket 50 on shaft 39 is connected via a chain 51 to sprocket 52 mounted on the end of the brush shaft 26.

In certain installations where the roofing is not heavily nailed to the roof deck, the blade 21 can be used to remove the old roofing, while in other situations where the roofing may be heavily nailed, a separate roof removing device, as shown in U.S. Pat. No. 3,542,433 may be employed to remove or dislodge the old roofing. In this latter situation, the apparatus of the invention is employed to move the dislodged roofing fragments or sections from the rood.

In certain instances the operator may not require the use of the brush 25, in which case it can be lifted through operation of the arm 28*a* to elevate the brush above the blade.

The apparatus of the invention substantially reduces the manual labor normally associated with removing the dislodged pieces of roofing from the roof deck and transporting the dislodged roofing pieces to a collection site. As the cost of a new roof depends in large part on the cost of removing the old roofing, the use of the apparatus of the invention procudes a substantial cost advantage.

While the apparatus has been described as being used in connection with roofing materials, it is contemplated it can also be used to remove a wide variety of materials from a surface, such as gravel, soil, waste materials, rubbish, snow, and the like, and has particular application where the debris or material may have considerable weight or bulk.

Various modes of carrying out the invention are contemplated as being within the scope of the following claims particularly pointing out and distinctly claiming the subject matter which is regarded as the invention.

I claim:

1. A self-propelled apparatus for dislodging material from the surface and conveying the material for collection, comprising a self propelled vehicle including a frame, a scraping member extending transversely of the vehicle and mounted forwardly of the frame, said scraping member comprising a blade having a relatively sharp edge disposed to engage a surface as the vehicle is propelled to dislodge material from the surface, conveying means mounted on the frame and located to the rear of the scraping member in position to receive dislodged material from the scraping member and convey the dislodged material rearwardly to a position for collection, a brush having a plurality of flexible bristles and mounted adjacent to the forward edge of the scraping member, and means for rotating the brush whereby the brush will sweep dislodged material rearwardly across the scraping member to the conveying means.

2. The apparatus of claim 1, wherein said brush comprises a shaft, said flexible bristles extending outwardly from the shaft, and a generally rigid elongated member extending outwardly from the shaft and disposed among the bristles.

3. The apparatus of claim 2, wherein said rigid member has a shorter length than said bristles whereby the outer extremity of said rigid member will be located inwardly of the outer extremities of said bristles, said bristles being arranged to rotate in contact with said scraping member and adapted to sweep lighter weight dislodged material to said conveying means, and said rigid member arranged to rotate out of contact with said scraping member and adapted to sweep heavier weight dislodged material to said conveying means.

4. The apparatus of claim 2, wherein said scraping member is provided with a groove to receive the rigid member as said brush is rotated.

5. The apparatus of claim 4, and including support means connected to the brush for positioning the outer extremity of the rigid member with respect to said groove.

6. The apparatus of claim 2, and mounting means for mounting the brush for movement in a direction toward and away from said scraping member, biasing means for biasing the brush toward said scraping member, and spacing means for spacing the extremities of the rigid elongated member from said scraping member.

7. A self-propelled apparatus for dislodging material from a surface and conveying the dislodged material for collection, comprising a self propelled vehicle including a frame, a blade extending forwardly of the frame and disposed to scrape material from said surface, an endless conveyor mounted on the frame and located to the rear of the blade in position to receive dislodged material from the blade and convey the dislodged material rearwardly to a position for collection, a brush located adjacent the forward end of the blade and having a series of bristles disposed to rotate in contact with said blade and sweep dislodged materials across the blade toward the conveyor, means for rotating the brush, said brush comprising a shaft and a plurality of generally flexible bristles extending outwardly from said shaft, said brush also including a plurality of generally rigid members extending outwardly from said shaft and disposed among said bristles, and mounting means connected to the brush for positioning the outer extremity of the rigid member with respect to said blade.

8. The apparatus of claim 7, wherein said blade is provided with at least one groove extending in a forward-to-rear direction, said groove disposed to receive said rigid members as the brush is rotated.

9. The apparatus of claim 8, and including wheel means operably connected to the mounting means for positioning the outer extremities of said rigid members with respect to the groove, whereby said outer extremities are spaced from the bottom of said groove.

10. The apparatus of claim 7, wherein said mounting means is pivotally connected to the frame.

11. The apparatus of claim 7, wherein each of said conveyor includes an endless belt and a drive roll for driving said endless belt and located adjacent said blade, said mounting means including a pair of arms mounted for pivoting movement about the axis of said drive roll.

12. The apparatus of claim 7, wherein each of said rigid members comprises an elongated finger extending radially of said brush and having a shorter length than said bristles, whereby the outer extremity of each of said fingers is located radially inward of the outer extremity of said bristles.

* * * * *